US006439810B1

(12) United States Patent
Nish et al.

(10) Patent No.: US 6,439,810 B1
(45) Date of Patent: Aug. 27, 2002

(54) BUOYANCY MODULE WITH PRESSURE GRADIENT WALLS

(75) Inventors: Randall W. Nish, Provo; Daniel C. Kennedy, II, Salt Lake City, both of UT (US)

(73) Assignee: EDO Corporation, Fiber Science Division, Salt Lake City, UT (US)

( * ) Notice: Subject to any disclaimer, the term of this patent is extended or adjusted under 35 U.S.C. 154(b) by 0 days.

(21) Appl. No.: 09/574,977

(22) Filed: May 19, 2000

(51) Int. Cl.[7] ..... E21B 41/00; E21B 41/04

(52) U.S. Cl. ..... 405/224.2; 405/224.4; 166/350

(58) Field of Search ..... 405/195.1, 224.2, 405/224.4; 166/350, 354, 359

(56) References Cited

U.S. PATENT DOCUMENTS

| | | | | | |
|---|---|---|---|---|---|
| 3,470,838 | A | | 10/1969 | Daniell | 114/267 |
| 4,176,986 | A | * | 12/1979 | Taft et al. | 166/350 |
| 4,256,417 | A | * | 3/1981 | Bohannon | 405/224.2 |
| 4,511,287 | A | * | 4/1985 | Horton | 405/195.1 |
| 4,596,531 | A | * | 6/1986 | Schawann et al. | 166/350 |
| 4,702,321 | A | | 10/1987 | Horton | 166/350 |
| 4,808,034 | A | * | 2/1989 | Birch | 405/204 |
| 4,934,871 | A | * | 6/1990 | Kazokas, Jr. | 405/224.2 |
| 5,044,828 | A | * | 9/1991 | Berner, Jr. et al. | 405/202 |
| 5,439,060 | A | * | 8/1995 | Huete et al. | 166/367 |
| 5,447,392 | A | * | 9/1995 | Marshall | 405/224.4 |
| 5,558,467 | A | | 9/1996 | Horton | 405/195.1 |

* cited by examiner

*Primary Examiner*—Robert E. Pezzuto
*Assistant Examiner*—Tara L. Mayo
(74) *Attorney, Agent, or Firm*—Thorpe North & Western

(57) ABSTRACT

A buoyancy system for a deep water floating platform includes at least one composite buoyancy module coupled to a riser. The module includes an elongate vessel with a vessel wall, and upper and lower ends. The vessel is attached to the riser, vertically oriented, and submerged under a surface of water such that the upper end is disposed at a lower water pressure, and the lower end at a higher water pressure. The vessel wall has a thickness that varies from a thinner wall thickness at the lower end to a thicker wall thickness at the upper end. The vessel may be internally pressurized with air such that an internal air pressure of the vessel substantially equals the higher water pressure at the lower end of the vessel resulting in a lower pressure differential at the lower end with the thinner wall thickness and a higher pressure differential at the top end with the thicker wall thickness. The module is sized to have a volume to produce a buoyancy force at least as great as the weight of the riser.

24 Claims, 8 Drawing Sheets

BUOYANCY MODULE WITH PRESSURE GRADIENT WALLS

BACKGROUND OF THE INVENTION

1. The Field of the Invention

The present invention relates generally to a buoyancy module or can for supporting a riser of a deep water, floating oil platform. More particularly, the present invention relates to a buoyancy module with a tapering wall thickness.

2. The Background Art

As the cost of oil increases and/or the supply of readily accessible oil reserves are depleted, less productive or more distant oil reserves are targeted, and oil producers are pushed to greater extremes to extract oil from the less productive oil reserves, or to reach the more distant oil reserves. Such distant oil reserves may be located below the oceans, and oil producers have developed offshore drilling platforms in an effort to extend their reach to these oil reserves.

In addition, some oil reserves are located farther offshore, and hundreds of feet below the surface of the oceans. Floating oil platforms, known as spars, or Deep Draft Caisson Vessels (DDCV) have been developed to reach these oil reserves, examples of which are described in U.S. Pat. Nos. 4,702,321 and 5,558,467. Steel tubes or pipes, known as risers, are suspended from these floating platforms, and extend the hundreds of feet to reach the ocean floor, and the oil reserves.

It will be appreciated that these risers, formed of hundreds of feet of steel pipe, have a substantial weight which must be supported by buoyant elements at the top of the risers. Steel air cans have been developed which are coupled to the risers and disposed in the water to help buoy the risers, and eliminate the strain on the floating platform, or associated rigging. One disadvantage with the air cans is that they are formed of metal, and thus add considerable weight themselves. Thus, the metal air cans must support the weight of the risers and themselves. In addition, the air cans are often built to pressure vessel specifications, and are thus costly and time consuming to manufacture.

In addition, as risers have become longer by going deeper, their weight has increased substantially. One solution to this problem has been to simply add additional air cans to the riser so that several air cans are attached in series. It will be appreciated that the diameter of the air cans is limited to the width of the platform structure, while the length is merely limited by the practicality of handling the air cans. For example, the length of the air cans is limited by the ability or height of the crane that must lift and position the air can. One disadvantage with more and/or larger air cans is that the additional cans or larger size adds more and more weight which also be supported by the air cans, decreasing the air can's ability to support the risers. Another disadvantage with merely stringing a number air cans is that long strings of air cans may present structural problems themselves. For example, a number of air cans pushing upwards on one another, or on a stem pipe, may cause the cans or stem pipe to buckle.

SUMMARY OF THE INVENTION

It has been recognized that it would be advantageous to optimize the systems and processes of accessing distant oil reserves, such as deep water oil reserves. In addition, it has been recognized that it would be advantageous to develop a system for reducing the weight of air cans, and thus the riser system and platforms. In addition, it has been recognized that it would be advantageous to develop a system for increasing the buoyancy of the air cans.

The invention provides a buoyancy system and or buoyancy module. The buoyancy module is vertically oriented, disposed below the surface of the water and coupled to a riser or stem pipe to support the riser. One or more buoyancy modules may be sized to have a volume to produce a buoyancy force at least as great as the riser.

The buoyancy module includes an elongate vessel with a vessel wall, and upper and lower ends. The vessel wall has a thickness that advantageously varies from a thinner wall thickness at the lower end, to a thicker wall thickness at the upper end. The upper end with the thicker wall thickness is disposed at a lower water pressure, and the lower end with the thinner wall thickness is disposed at a higher water pressure. The vessel may be internally pressurized with air so that an internal air pressure of the vessel substantially equals the higher water pressure at the lower end of the vessel. Thus, a lower pressure differential exists at the lower end with the thinner wall thickness, and a higher pressure differential exists at the top end with the thicker wall thickness.

In accordance with one aspect of the present invention, the vessel wall tapers substantially continuously. Alternatively, the vessel wall may include at least two different sections of continuous or constant thickness. A lower section may have a thinner continual thickness, and an upper section may have a thicker continual thickness.

In accordance another aspect of the present invention, the riser may be over 1000 feet long with an associated weight, and the buoyancy module advantageously may include an elongated vessel with a composite vessel wall. Preferably, the composite vessel wall advantageously has a decrease in weight when submerged. In addition, the composite vessel wall preferably has a density less than the density of the riser. Furthermore, the composite vessel wall preferably has a coefficient of thermal expansion less than a coefficient of thermal expansion of the riser. The composite vessel wall also may have a thermal conductivity less than a thermal conductivity of the riser.

In accordance with another aspect of the present invention, the buoyancy module may include a stem pipe which extends concentrically within the vessel, with an upper end of the vessel coupled to the stem pipe. The riser is received through the stem pipe. Alternatively, the buoyancy vessel or module may be coupled directly to the riser.

A spider structure may be attached to the vessel to position the stem pipe concentrically within the vessel. The spider structure may have an annular member with an aperture receiving the stem pipe therethrough, and a plurality of arms attached to and extending between the vessel and the annular member.

In accordance with another aspect of the present invention, more than one buoyancy modules advantageously may be limited to manageable sized but coupled together to achieve a desired buoyancy. A second elongate vessel may have an upper end directly attached to the lower end of the first elongate vessel. The first and second elongate vessels may have different lengths, and different volumes.

Additional features and advantages of the invention will be set forth in the detailed description which follows, taken in conjunction with the accompanying drawing, which together illustrate by way of example, the features of the invention.

DETAILED DESCRIPTION

Figure 1:
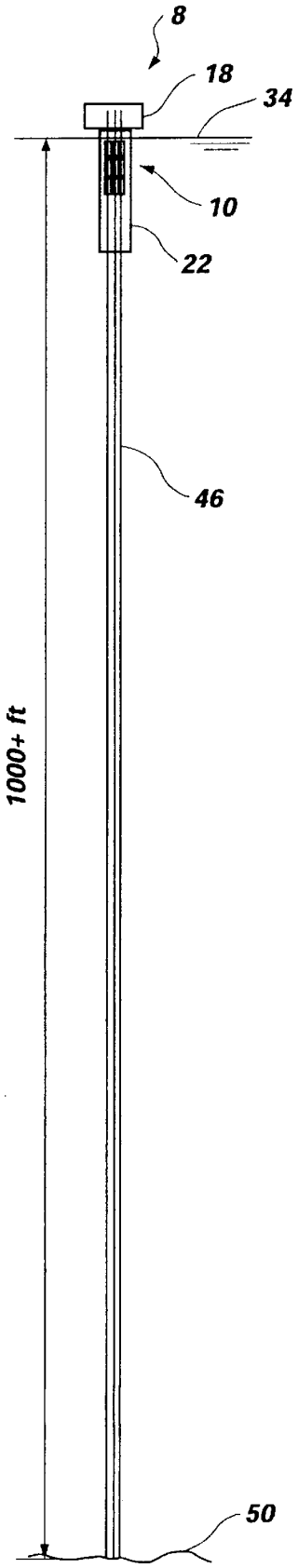
FIG. 1 is a schematic of a deep water, floating oil platform called a spar or Deep Draft Caisson Vessel with risers utilizing a modular buoyancy system in accordance with the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Figure 2:
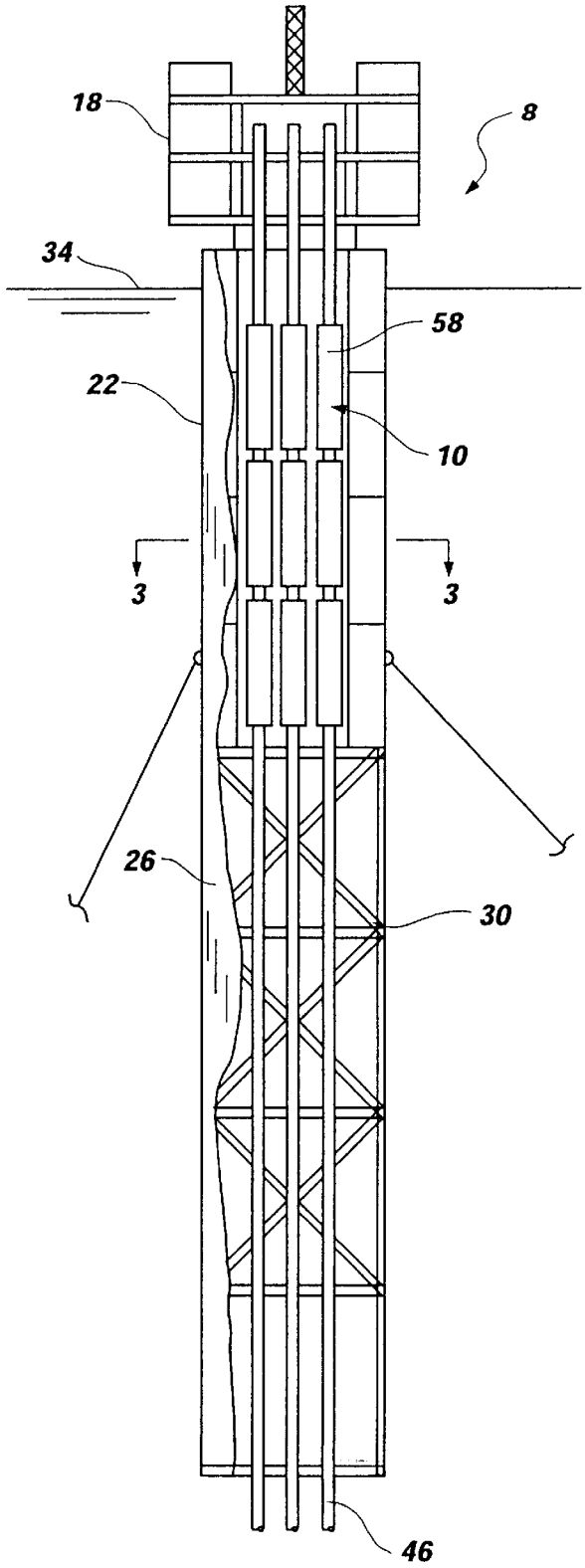
FIG. 2 is a partial, broken-away view of a preferred embodiment of the deep water, floating oil platform of FIG. 1 utilizing the modular buoyancy system in accordance with the present invention.

As illustrated in FIGS. 1 and 2, a deep water, floating oil platform, indicated generally at 8, is shown with a buoyancy system, indicated generally at 10, in accordance with the present invention. Deep water oil drilling and production is one example of a field which may benefit from use of such a buoyancy system 10. The term "deep water, floating oil platform" is used broadly herein to refer to buoyant platforms located above or below the surface, such as are utilized in drilling and/or production of fuels, such as oil and gas, typically located off-shore in the ocean at locations corresponding to depths of over several hundred or thousand feet, including classical, truss, and concrete spar-type platforms or Deep Draft Caisson Vessels, etc. Thus, the fuel, oil or gas reserves are located below the ocean floor at depths of over several hundred or thousand feet of water.

A classic, spar-type, floating platform 8 or Deep Draft Caisson Vessel is shown in FIGS. 1 and 2, and has both above-water, or topside, structure 18, and below-water, or submerged, structure 22. The above-water structure 18 includes several decks or levels which support operations such as drilling, production, etc., and thus may include associated equipment, such as a workover or drilling rig, production equipment, personnel support, etc. The submerged structure 22 may include a hull 26, which may be a full cylinder form. The hull 26 may include bulkheads, decks or levels, fixed and variable seawater ballasts, tanks, etc. The fuel, oil or gas may be stored in tanks in the hull. The platform 8, or hull, also has mooring fairleads to which mooring lines, such as chains or wires, are coupled to secure the platform or hull to a pile in the sea floor.

The hull 26 also may include a truss or structure 30. The hull 26 and/or truss 30 may extend several hundred feet below the surface 34 of the water, such as 650 feet deep. A centerwell or moonpool 38 (See FIG. 3) is located in the hull 26. The buoyancy system 10 is located in the hull 26, truss 30, and/or centerwell 38. The centerwell 38 is typically flooded and contains compartments 42 (FIG. 3) or sections for separating the risers and the buoyancy system 10. The hull 26 provides buoyancy for the platform 8 while the centerwell 38 protects the risers and buoyancy system 10.

It is of course understood that the classic, spar-type or DDCV, floating platform depicted in FIGS. 1 and 2 is merely exemplary of the types of floating platforms which may be utilized. For example, other spar-type platforms may be used, such as truss spars, or concrete spars.

The buoyancy system 10 supports deep water risers 46 which extend from the floating platform 8, near the water surface 34, to the bottom 50 of the body of water, or ocean floor. The risers 46 are typically steel pipes or tubes with a hollow interior for conveying the fuel, oil or gas from the reserve, to the floating platform 8. The term "deep water risers" is used broadly herein to refer to pipes or tubes extending over several hundred or thousand feet between the reserve and the floating platform 8, including production risers, drilling risers, and export/import risers. The risers may extend to a surface platform or a submerged platform. The deep water risers 46 are coupled to the platform 8 by a thrust plate 54 (FIG. 4) located on the platform 8 such that the risers 46 are suspended from the thrust plate 54. In addition, the buoyancy system 10 is coupled to the thrust plate 54 such that the buoyancy system 10 supports the thrust plate 54, and thus the risers 46, as discussed in greater detail below.

Preferably, the buoyancy system 10 is utilized to access deep water reserves, or with deep water risers 46 which extend to extreme depths, such as over 1000 feet, more preferably over 3000 feet, and most preferably over 5000 feet. It will be appreciated that thousand feet lengths of steel pipe are exceptionally heavy, or have substantial weight. It also will be appreciated that steel pipe is thick or dense (i.e. approximately 0.283 lbs/in$^3$), and thus experiences relatively little change in weight when submerged in water, or seawater (i.e. approximately 0.037 lbs/in$^3$). Thus, for example, steel only experiences approximately a 13% decrease in weight when submerged. Therefore, thousands of feet of riser, or steel pipe, is essentially as heavy, even when submerged.

Figure 4:
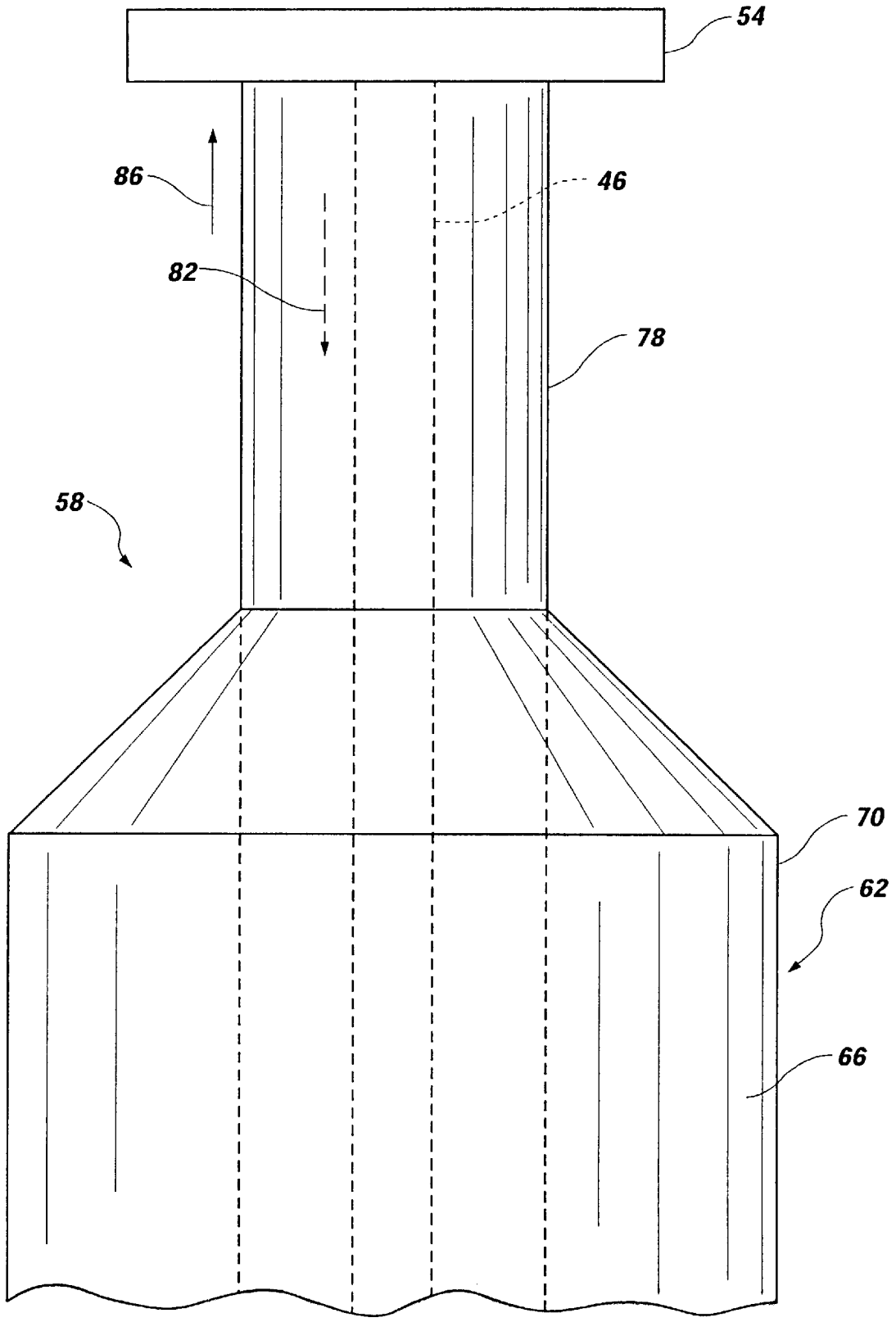
FIG. 4 is a partial side view of the modular buoyancy system in accordance with the present invention coupled to a stem pipe and riser.
Figure 5:
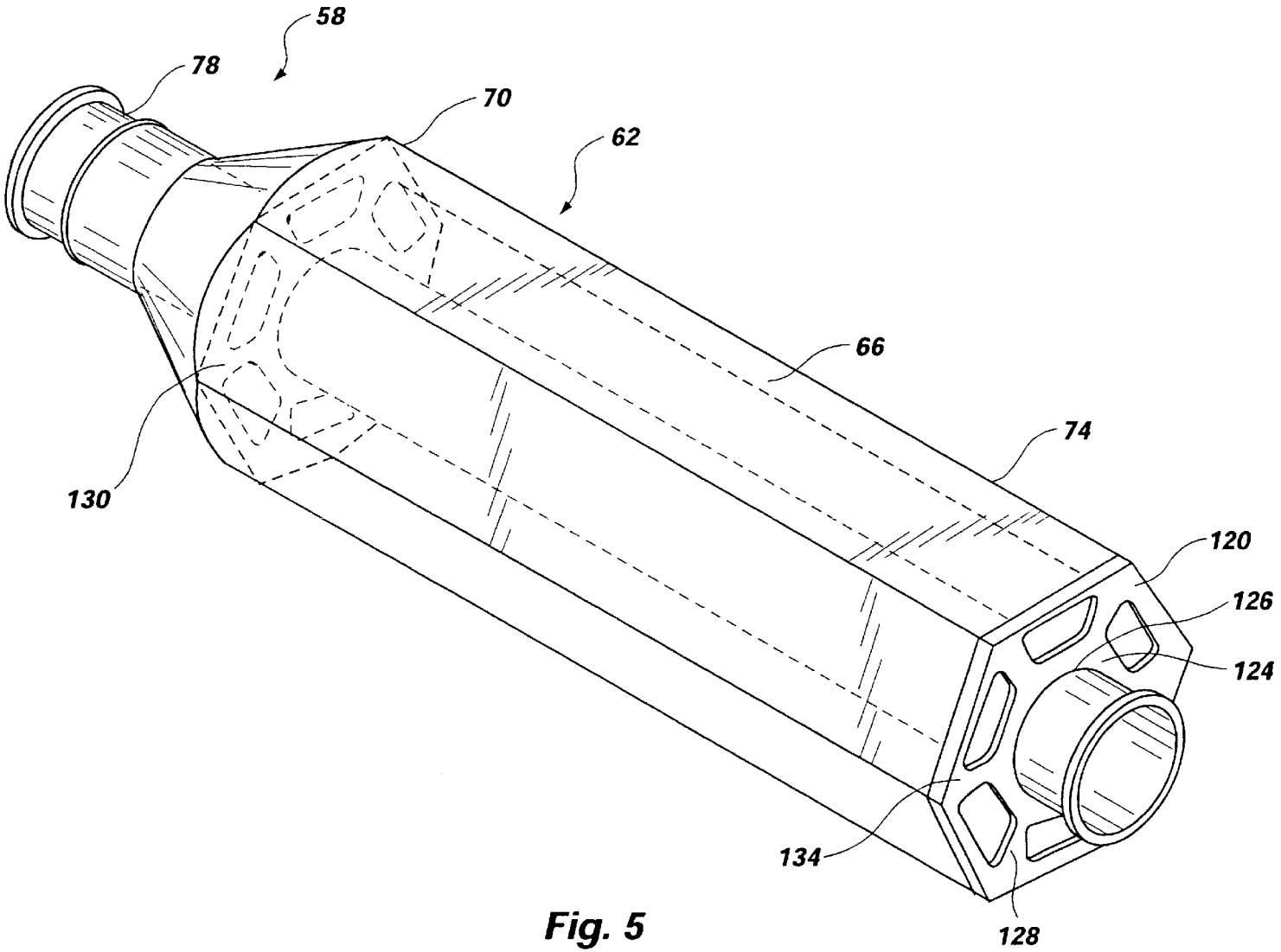
FIG. 5 is a perspective view of a buoyancy module in accordance with the present invention.

The buoyancy system 10 includes one or more buoyancy modules or vessels 58 which are submerged and filled with air to produce a buoyancy force to buoy or support the risers 46. Referring to FIG. 5, the buoyancy module 58 includes an elongate vessel 62 with a wall 66 or shell. The elongate vessel 62 is vertically oriented, submerged, and coupled to one or more risers 46 via the thrust plate 54 (FIG. 4). The vessel 62 has an upper end 70 and a lower end 74.

Figure 6:
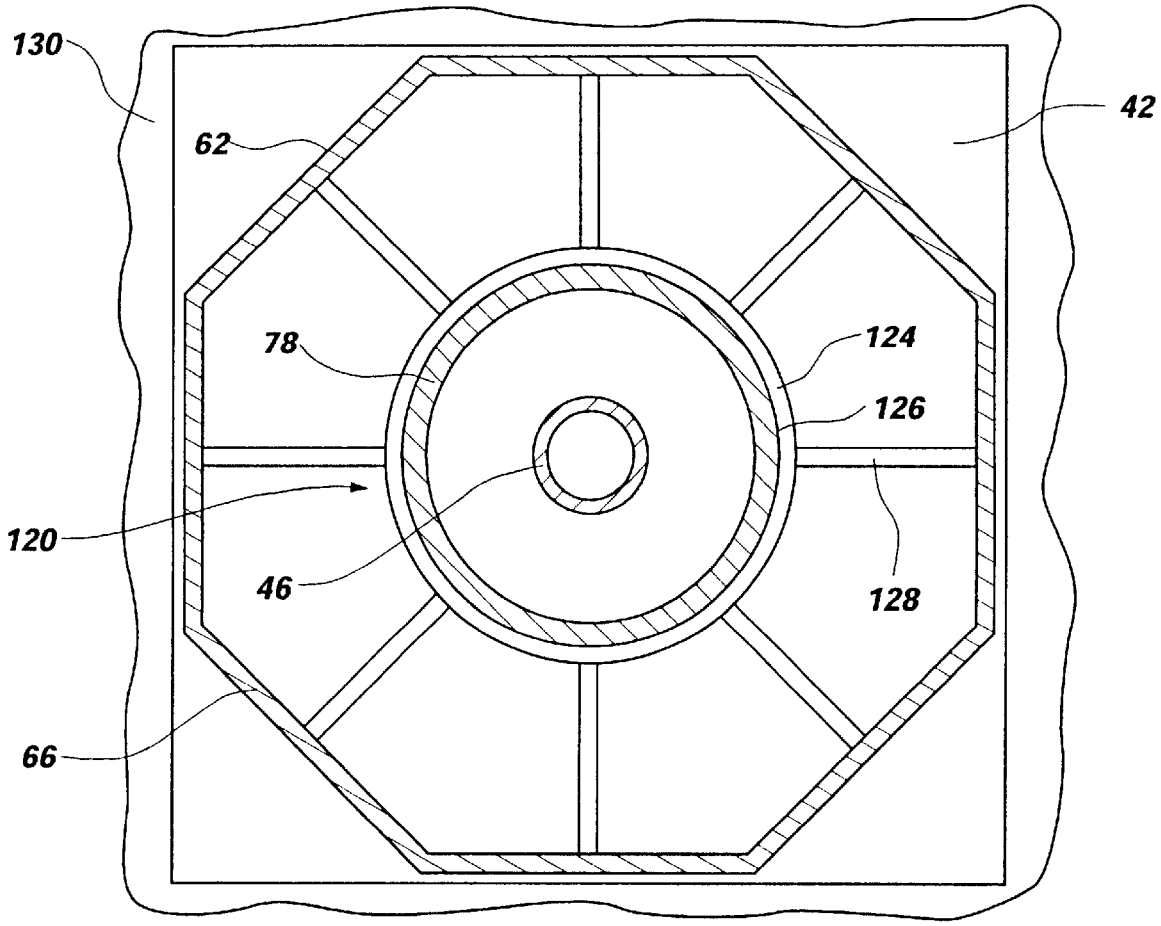
FIG. 6 is a cross-sectional view of a buoyancy module in accordance with the present invention.

In addition, the buoyancy module 58 may include a stem pipe 78 extending through the vessel 62 concentric with a longitudinal axis of the vessel 62. Preferably, the upper end 70 of the vessel 62 is coupled or attached to the stem pipe 78. As shown in FIG. 4, the stem pipe 78 may be directly coupled to the thrust plate 54 to couple the vessel 62 and buoyancy module 58 to the thrust plate 54, and thus to the riser 46. The stem pipe 78 may be sized to receive one or more risers 46 therethrough, as shown in FIG. 6.

Therefore, the risers 46 exert a downward force, indicated by arrow 82 in FIG. 4, due to their weight on the thrust plate 54, while the buoyancy module 58 or vessel 62 exerts an upward force, indicated by arrow 86 in FIG. 4, on the thrust plate 54. Preferably, the upward force 86 exerted by the one or more buoyancy modules 58 is equal to or greater than the downward force 82 due to the weight of the risers 46, so that the risers 46 do not pull on the platform 8 or rigging.

As stated above, the thousands of feet of risers 46 exert a substantial downward force 82 on the buoyancy system 10 or buoyancy module 58. It will be appreciated that the deeper the targeted reserve, or as drilling and/or production moves from hundreds of feet to several thousands of feet, the risers 46 will become exceedingly more heavy, and more and more buoyancy force 86 will be required to support the risers 46. It has been recognized that it would be advantageous to optimize the systems and processes for accessing deep reserves, to reduce the weight of the risers and platforms, and increase the buoyance force.

Figure 7:
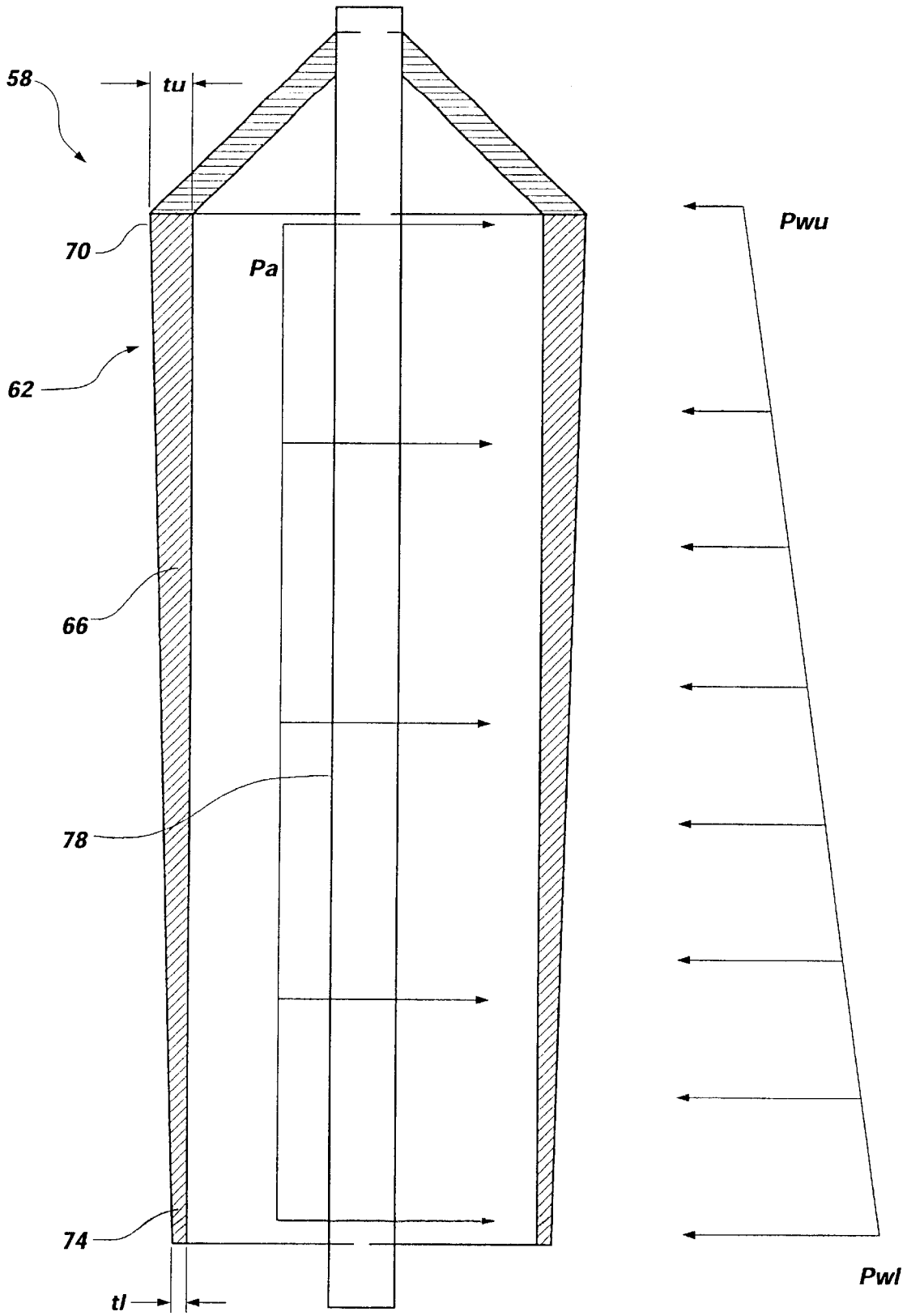
FIG. 7 is a cross-sectional side view of a buoyancy system in accordance with the present invention.

Referring to FIG. 7, the buoyancy module 58, vessel 62, or vessel wall 66 advantageously has a thickness which varies from a thinner wall thickness $t_1$ at the lower end 74, to a thicker wall thickness $t_u$ at the upper end 70. The varying wall thickness of the vessel wall 66, or thinner wall thickness $t_1$ at the lower end 74 advantageously reduces the amount of material, thus reducing cost and weight. Therefore, the buoyancy module 58 or vessel is able to provide a greater buoyant force or support for the riser 46, because the weight of the buoyancy module 58 itself has been reduced.

It will be appreciated that the upper end 70 of the buoyancy module 58 is disposed at a first, lower water pressure $P_{wu}$ while the lower end 74 is disposed at a second, higher water pressure $P_{w1}$. Thus, the upper end 70 with the thicker wall thickness $t_u$ is located at the lower water pressure $P_{wu}$, while the lower end 74 with the thinner wall thickness $t_1$ is located at the higher water pressure $P_{wu}$. The buoyancy module 58 or vessel 62 may be internally pressurized, such as by increasing the air pressure, to have an internal pressure $P_a$. The internal pressure $P_a$ may substantially equal the higher water pressure $P_{w1}$ at the lower end 74 of the vessel 66. Thus, the lower end 74 of the vessel 66 may be open to the water, while the air pressure $P_a$ in the vessel 66 substantially prevents water from entering, and increases the buoyancy of the vessel 66.

It will be appreciated that a water pressure differential ($P_{w1}-P_{wu}$) exists along the vertical elevation of the water, and thus exists along the length of the buoyancy module 58, while the internal pressure $P_a$ of the vessel 66 is substantially the same at all points within the vessel 66. Thus, a pressure differential exist along the vessel wall 66 which varies from a higher pressure differential at the upper end 70, to a lower or zero pressure differential at the lower end 74. Thus, the thicker wall thickness $t_u$ is located at the upper end 70 where the higher pressure differential ($P_a-P_{wu}$) exists, while the thinner wall thickness $t_1$ is located at the lower end 74 where the lower pressure differential ($P_a-P_{w1}\approx 0$) exists.

The buoyancy module 58 or vessel 62 preferably has a diameter or width of approximately 3 to 4 meters, and a length of approximately 10 to 20 meters. The diameter or width of the buoyancy modules 58 is limited by the size or width of the compartments 42 of the centerwell 38 or grid structure 112, while the length is limited to a size that is practical to handle.

The thickness of the vessel wall 66 preferably tapers from a thinner wall thickness $t_1$ at the lower end 74 between approximately 0.5 to 2.5 centimeters, to a thicker wall thickness $t_u$ at the upper end 70 between approximately 1 to 5 centimeters. In addition, the vessel wall 66 may, for example, variy in thickness per unit length between approximately 0.03 to 0.023 cm/meter. Furthermore, the vessel wall may taper substantially continuously, as shown in FIG. 7.

Figure 8:
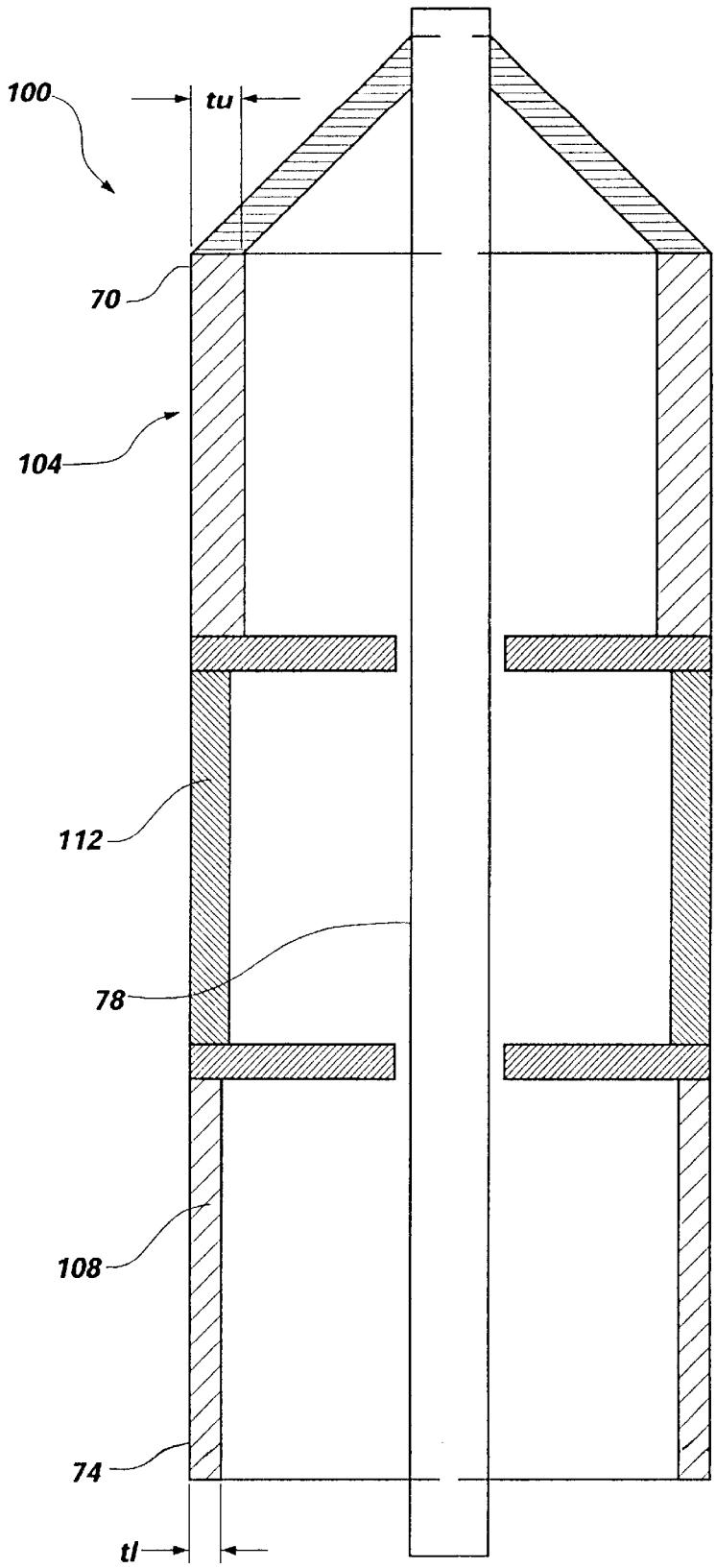
FIG. 8 is a cross-sectional side view of another buoyancy system in accordance with the present invention.

Referring to FIG. 8, a buoyancy module 100, alternatively may have various sections with vessel walls of continuous thickness, as opposed to a continuous taper, to achieve thinner wall thickness $t_1$ at the lower end 74, and a thicker wall thickness $t_u$ at the upper end 70. In addition, the buoyancy module 100 advantageously may be modular, and include more than one buoyancy modules to obtain the desired volume, or buoyancy force, while maintaining each individual module at manageable lengths. For example, a first or upper module, vessel or section 104 may be provided with a substantially constant thicker wall thickness $t_u$, while a second or lower buoyancy module or section 108 may be attached to the first 104 and have a substantially constant thinner wall thickness $t_1$. Intermediate sections or modules 112 with intermediate wall thicknesses may be disposed between the upper and lower sections 104 and 108.

In addition, the sections or modules may be combined to obtain the desired volume or buoyancy force. For example, the first, second and intermediate modules 104, 108 and 112 each may be 10 meters long to obtain a combined length of 30 meters and the desired buoyancy force. It will be appreciated that the buoyancy modules may be provided in manageable sizes for transportation and handling, and assembled when convenient, such as on site, to achieve the desired buoyancy force based on the length of the risers 46.

It is of course understood that the various sections or vessels 104, 108 and 112 described above with continuous wall thicknesses, also may have various wall thicknesses as described previously so that two or more vessels or sections have varying wall thicknesses.

Referring again to FIG. 7, the vessel 62 advantageously is a composite vessel, and the vessel wall 66 advantageously is formed of a fiber reinforced resin. The vessel 62 or vessel wall 66 preferably has a density of approximately 0.072 $lbs/in^3$. Therefore, the composite vessel 62 is substantially lighter than prior art air cans. In addition, the composite vessel 62 or vessel wall 66 advantageously experiences a significant decrease in weight, or greater decrease than metal or steel, when submerged. Preferably, the composite vessel 62 experiences a decrease in weight when submerged between approximately 25 to 75 percent, and most preferably between approximately 40 to 60 percent. Thus, the composite vessel 62 experiences a decrease in weight when submerged greater than three times that of steel.

The one or more buoyancy modules 58, or vessels 62, preferably have a volume sized to provide a buoyancy force 86 at least as great as the weight of the submerged riser 46. It will also be appreciated that motion of the floating platform 8, water motion, vibration of the floating platform 8 and associated equipment, etc., may cause the risers 46 to vibrate or move. Thus, the buoyancy modules 58 or vessels 62 more preferably have a volume sized to provide a buoyancy force at least approximately 20 percent greater than the weight of the submerged risers 46 in order to pull the risers 46 straight and tight to avoid harmonics, vibrations, and/or excess motion.

Referring to FIGS. 5 and 6, the buoyancy module 58 may include one or more spider structures 120 disposed at locations along the length thereof to support the vessel 62 and/or reinforce the structure and alignment of the vessel 62 and stem pipe 78. The spider structure 120 may be attached to the vessel 62 and include an annular member 124 with an aperature 126 through which the stem pipe 78 is received. A plurality of arms 128 may be attached to and between the vessel 62 and the annular member 124. The buoyancy module 58 may include an upper spider structure 130 located at the top thereof, and a lower spider structure 134 located at the bottom thereof, as shown in FIG. 5. In addition, intermediate spider structures also may be provided.

The stem pipe 78 may be formed of a metal, such as steel or aluminum. The vessel 62, however, preferably is formed of a composite material. Thus, the materials of the stem pipe 78 and vessel 62 may have different properties, such as coefficients of thermal expansion. The composite material of the vessel 62 may have a coefficient of thermal expansion much lower than that of the stem pipe 78 and/or risers 48. Therefore, the stem pipe 78 is axially movable disposed within the aperture 126 of the spider structure 120, and thus axially movable with respect to the vessel 62. Thus, as the stem pipe 78 and vessel 62 expand and contract, they may do so in the axial direction with respect to one another. For example, the composite material of the vessel 62 may have a coefficient of thermal expansion between approximately 4.0 to $8.0\times 10^{-6}$ in/in/°F. for fiberglass reinforcement with epoxy, vinyl ester or polyester resin; or of $-4.4\times10^{-8}$ to $2.5\times10^{-6}$ in/in/°F. for carbon fiber reinforcement with epoxy, vinyl ester or polyester resin. In comparison, steel has a coefficient of thermal expansion between 6.0 to $7.0\times10^{-6}$ in/in/°F.; while aluminum has a coefficient of thermal expansion between 12.5 to $13.0\times10^{-6}$ in/in/°F. Thus, the composite vessel 62 advantageously has a much smaller coefficient of thermal expansion than the stem pipe 78, and experiences a smaller expansion or contraction with temperature changes.

Referring again to FIGS. 3 and 6, the floating platform 8 of hull 26 may include a centerwell 38 with a grid structure 130 with one or more square compartments 42, as described above. The risers 46 and buoyancy modules 58 are disposed in the compartments 42 and separated from one another by the grid structure 130. The compartments 42 may have a square cross-section with a crosssectional area. The buoyancy module 58 and/or vessel 62 may have a non-circular cross-section with a cross-sectional area greater than approximately 79 percent of the cross-sectional area of the compartment 42. Thus, the cross-sectional area, and thus the size, of the buoyancy module 58 and vessel 62 are maximized to maximize the volume and buoyancy force 86 of the buoyancy module 58. The buoyancy module 58 and vessel 62 may have a polygon cross-section, such as -hexagonal (FIG. 5). In addition, the vessel 62 may be circular (FIG. 7).

Figure 3:
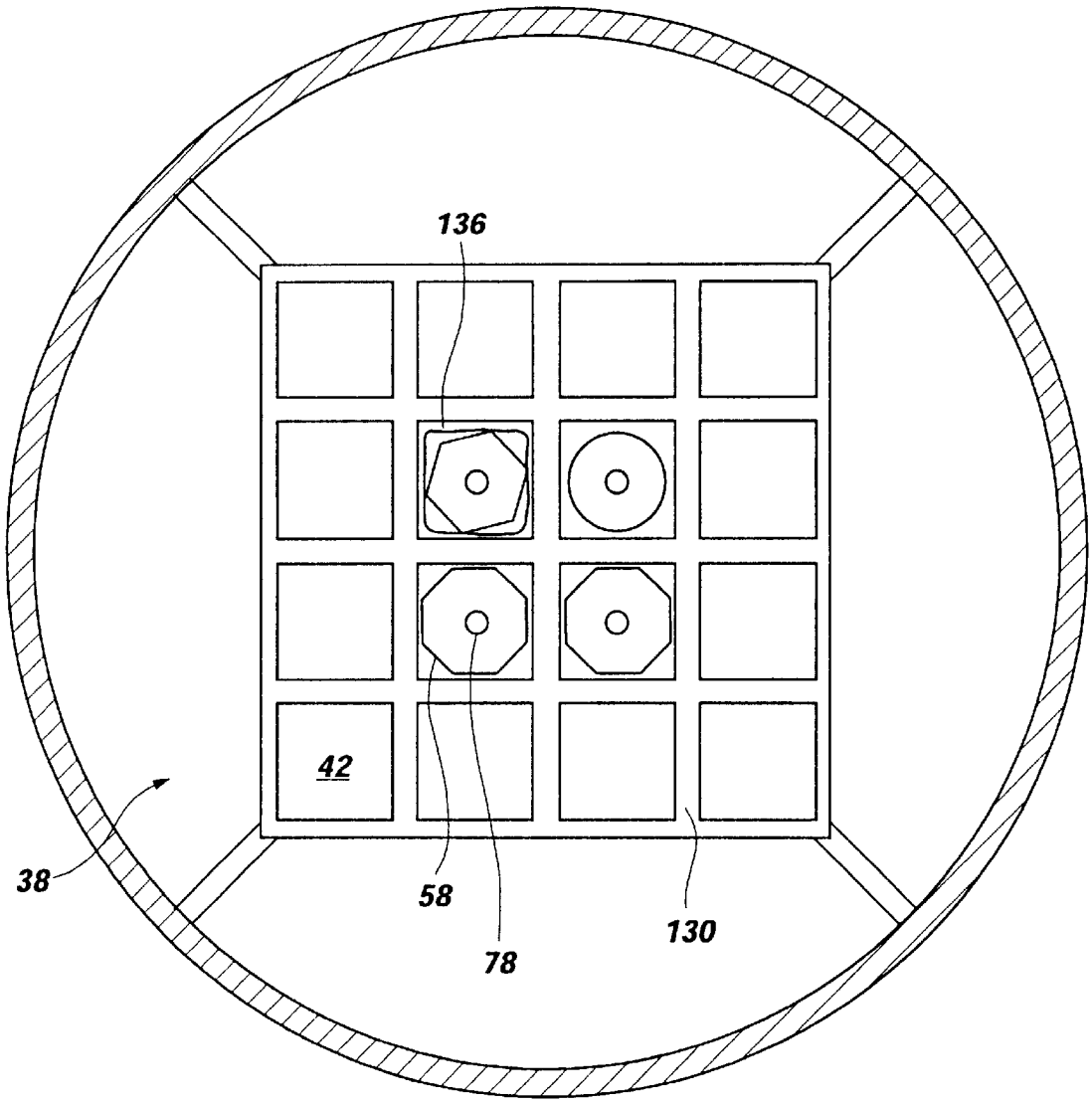
FIG. 3 is a cross-sectional view of the deep water, floating oil platform of FIG. 2 taken along line 3—3 utilizing the modular buoyancy system in accordance with the present invention.

Referring to FIG. 3, a bumper 136 may be disposed between the grid structure 130 and buoyancy module 58 to protect the buoyancy module 58 from damage as it moves within the compartment 42. The bumper 136 may be form of a flexible and/or resilient material to cushion impact or wear contact between the buoyancy module 58 and grid structure 130 as the buoyancy module 58 is installed.

Figure 9:
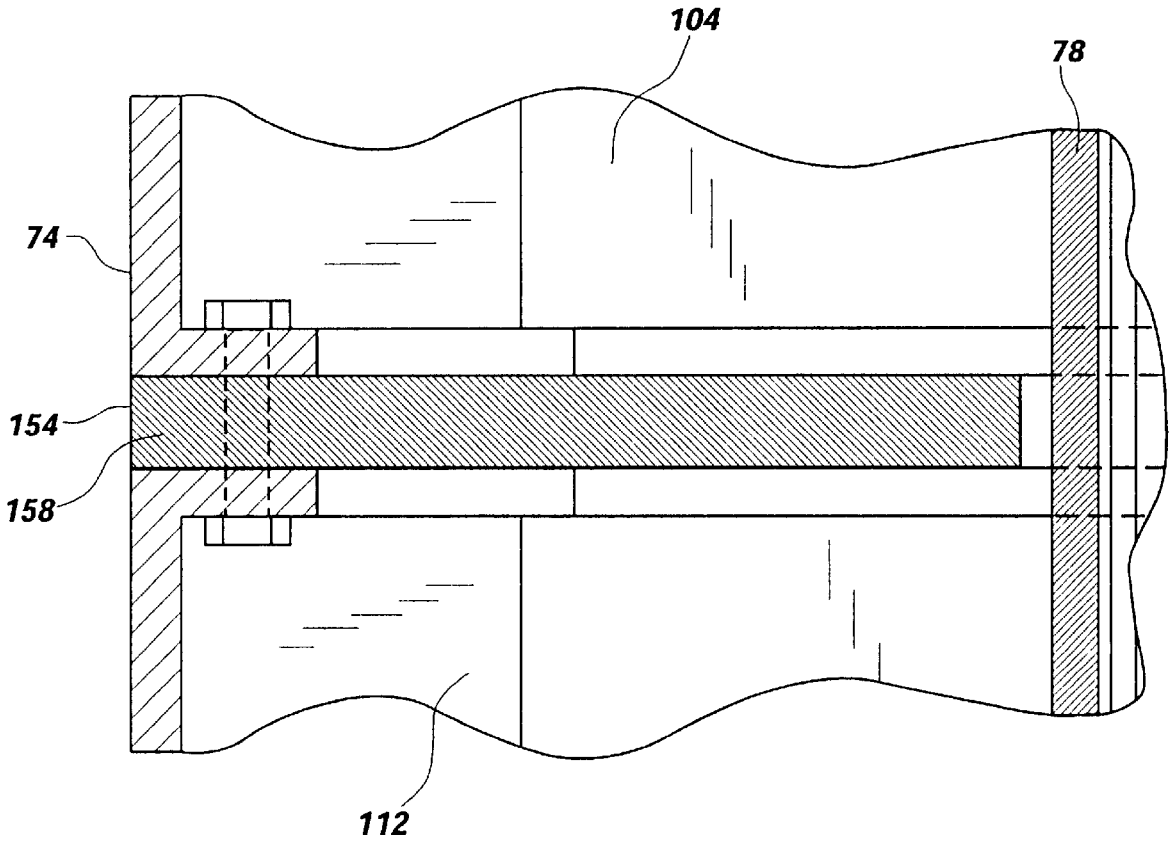
FIG. 9 is a partial cross-sectional view of the buoyancy system of FIG. 8.

Referring again to FIG. 9, another spider structure or wagon wheel structure 154 may be used to coupled the two vessels or sections 104 and 112, or 112 and 108 together. The spider structure 154 may be similar to the spider structure 120 described above. In addition, the spider structure 154 may include an outer annular member 158 which is located between the two modules 104 and 112 to form a seal.

It will be noted that the vessel 62 of the buoyancy module 58 described above may be attached directly to the riser 46, rather than the stem pipe 78.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A buoyancy module configured to be coupled to a deep water riser, comprising:

a) an elongate vessel having a vessel wall, and upper and lower ends;

b) the vessel wall having a thickness that varies from a thinner wall thickness at the lower end to a thicker wall thickness at the upper end;

c) the vessel being configured to be attached to the riser, vertically oriented, and submerged under a surface of water, such that the upper end with the thicker wall thickness is disposed at a lower water pressure, and the lower end with the thinner wall thickness is disposed at a higher water pressure; and d) the vessel being configured to be internally pressurized with air such that an internal air pressure of the vessel substantially equals the higher water pressure at the lower end of the vessel, resulting in a lower pressure differential at the lower end with the thinner wall thickness, and a higher pressure differential at the top end with the thicker wall thickness.

2. A buoyancy module in accordance with claim 1, wherein the vessel has a diameter between approximately 3 to 4 meters, a length greater between approximately 10 to 20 meters; and wherein the lower end of the vessel has a thickness between approximately 0.5 to 2.5 centimeters, and the upper end has a thickness of approximately 1 to 5 centimeters.

3. A buoyancy module in accordance with claim 1, wherein the vessel wall tapers substantially continuously.

4. A buoyancy module in accordance with claim 1, wherein the vessel wall has a change in thickness per unit length.

5. A buoyancy module in accordance with claim 1, wherein the vessel wall includes at least two different sections, including a lower section and an upper section, and wherein the lower section has a thinner continual thickness, and the upper section has a thicker continual thickness.

6. A buoyancy module in accordance with claim 1, wherein the vessel is configured to have a volume sized to produce a buoyancy force at least as great as a weight of a riser having a length greater than 1000 feet.

7. A buoyancy module in accordance with claim 1, wherein the vessel wall includes a composite vessel wall.

8. A buoyancy module in accordance with claim 7, wherein the composite vessel wall has a decrease in weight when submerged between approximately 25 to 75 percent.

9. A buoyancy module in accordance with claim 1, further comprising:

a stem pipe, extending concentrically within the vessel and coupled to an upper end of the vessel, and receiving the riser therethrough; and a spider structure, attached to the vessel, having an annular member with an aperture receiving the stem pipe therethrough, and a plurality of arms attached to and extending between the vessel and the annular member to position the stem pipe concentrically within the vessel.

10. A buoyancy module configured to be coupled to a deep water riser, comprising:

a) an elongate vessel having a vessel wall formed of a composite material, and upper and lower ends, and configured to be attached to the riser, vertically oriented, and submerged under a surface of water such that the upper end is disposed at a lower water pressure, and the lower end at a higher water pressure; and b) the vessel wall having a thickness that varies from a thinner wall thickness at the lower end to a thicker wall thickness at the upper end; and c) the vessel being configured to be internally pressurized with air such that an internal air pressure of the vessel substantially equals the higher water pressure at the lower end of the vessel resulting in a lower pressure differential at the lower end with the thinner wall thickness and a higher pressure differential at the top end with the thicker wall thickness.

11. A buoyancy module in accordance with claim 10, wherein the vessel has a diameter between approximately 3 to 4 meters, a length between approximately 10 to 20 meters; and wherein the lower end of the vessel has a thickness between approximately 0.5 to 2.5 centimeters, and the upper end has a thickness between approximately 1 to 5 centimeters.

12. A buoyancy module in accordance with claims 10, wherein the vessel wall tapers substantially continuously.

13. A buoyancy module in accordance with claim 10, wherein the vessel wall has a change in thickness per unit length.

14. A buoyancy module in accordance with claim 10, wherein the vessel wall includes at least two different sections, including a lower section and an upper section, and wherein the lower section has a thinner continual thickness, and the upper section has a thicker continual thickness.

15. A buoyancy module in accordance with claim 10, wherein the vessel has a volume sized to produce a buoyancy force at least as great as a weight of a riser having a length greater than 1000 feet.

16. A buoyancy module in accordance with claim 10, wherein the composite vessel wall has a decrease in weight when submerged between approximately 25 to 75 percent.

17. A buoyancy module in accordance with claim 10, further comprising:

a stem pipe, extending concentrically within the vessel and coupled to an upper end of the vessel, and receiving the riser therethrough; and a spider structure, attached to the vessel, having an annular member with an aperture receiving the stem pipe therethrough, and a plurality of arms attached to and extending between the vessel and the annular member to position the stem pipe concentrically within the vessel.

18. A modular buoyancy system configured to be coupled to a deep water riser, comprising:

an upper elongate vessel, configured to be submerged beneath a surface of water, vertically oriented, and coupled to the riser, and having an upper wall with a thickness, and upper and lower ends;

a lower elongate vessel, configured to be submerged beneath a surface of water and vertically oriented, and having an upper end directly attached to the lower end of the first elongate vessel, and further having a lower wall with a thickness thinner than the thickness of the upper wall; and the vessels being configured to be internally pressurized with air such that an internal air pressure of the vessels substantially equals the higher water pressure at the lower end of the lower vessel resulting in a lower pressure differential at the lower end with the thinner wall thickness and a higher pressure differential at the top end with the thicker wall thickness.

19. A modular buoyancy system in accordance with claim 18, wherein the upper and lower walls taper substantially continuously.

20. A modular buoyancy system in accordance with claim 18, wherein the vessel walls have a change in thickness per unit length.

21. A modular buoyancy system in accordance with claim 18, wherein the lower wall has a thinner continual thickness, and the upper wall has a thicker continual thickness.

22. A modular buoyancy system in accordance with claim 18, wherein the vessel walls include composite vessel walls.

23. A buoyancy system in accordance with claim 22, wherein the composite vessel walls have a decrease in weight when submerged between approximately 25 to 75 percent.

24. A modular buoyancy system in accordance with claim 18, further comprising:

a stem pipe, extending concentrically within the vessels and coupled to an upper end of the upper vessel, and receiving the riser therethrough; and a spider structure, attached between the vessels, having an annular member with an aperture receiving the stem pipe therethrough, and a plurality of arms attached to and extending between the vessels and the annular member to position the stem pipe concentrically within the vessels.

* * * * *